US011335277B2

(12) United States Patent
Wen et al.

(10) Patent No.: US 11,335,277 B2
(45) Date of Patent: May 17, 2022

(54) METHOD, APPARATUS, AND DEVICE FOR ADJUSTING BACKLIGHT BRIGHTNESS BASED ON HUMAN EYE CHARACTERISTICS

(71) Applicant: HUAWEI TECHNOLOGIES CO., LTD., Shenzhen (CN)

(72) Inventors: Jinsong Wen, Shenzhen (CN); Jinqin Ai, Shenzhen (CN); Haixiao Liu, Shanghai (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 21 days.

(21) Appl. No.: 16/918,988

(22) Filed: Jul. 1, 2020

(65) Prior Publication Data

US 2020/0335048 A1 Oct. 22, 2020

Related U.S. Application Data

(63) Continuation of application No. PCT/CN2018/125292, filed on Dec. 29, 2018.

(30) Foreign Application Priority Data

Jan. 5, 2018 (CN) ..... 201810012208.3

(51) Int. Cl.
*G09G 3/34* (2006.01)
*G09G 5/10* (2006.01)

(52) U.S. Cl.
CPC ..... *G09G 3/3406* (2013.01); *G09G 5/10* (2013.01); *G09G 2300/0465* (2013.01); *G09G 2320/0626* (2013.01); *G09G 2360/16* (2013.01)

(58) Field of Classification Search
CPC ..... G09G 3/3406; G09G 5/10; G09G 2300/0465; G09G 2320/0626;
(Continued)

(56) References Cited

U.S. PATENT DOCUMENTS 8,373,644 B2 * 2/2013 Koike ..... G09G 3/3426 345/102
8,711,083 B2 * 4/2014 Lee ..... G09G 3/3611 345/102
(Continued)

FOREIGN PATENT DOCUMENTS

CN 101281730 A 10/2008
CN 101620819 A 1/2010
(Continued)

*Primary Examiner* — Rodney Amadiz
(74) *Attorney, Agent, or Firm* — Stein IP, LLC

(57) ABSTRACT

A method, an apparatus, and a device for adjusting screen backlight brightness. The method includes: obtaining image information and information about an environment; determining human eye characteristic information based on the image information and the information about the environment, where the human eye characteristic information is related to a minimum magnitude of a brightness change perceptible to human eyes; obtaining information about a display screen, calculating a screen backlight decreasable ratio based on the information about the display screen, the human eye characteristic information, and the image information; and determining a screen pixel brightness compensation value based on the backlight decreasable ratio, adjusting backlight brightness based on the screen backlight decreasable ratio, and adjusting the screen pixel brightness value based on the screen pixel brightness compensation value.

19 Claims, 7 Drawing Sheets

(58) Field of Classification Search
CPC ..... G09G 2360/16; G09G 2370/04; G09G 2330/021; G09G 2320/0646; G09G 2360/144
See application file for complete search history.

(56) References Cited

U.S. PATENT DOCUMENTS

| | | | | |
|---|---|---|---|---|
| 8,860,657 | B2 * | 10/2014 | Lee | G09G 3/3426 345/102 |
| 2010/0295877 | A1 | 11/2010 | Yun | |
| 2011/0074803 | A1 | 3/2011 | Kerofsky | |
| 2011/0157253 | A1 | 6/2011 | Yamazaki et al. | |
| 2012/0092393 | A1 * | 4/2012 | Lu | H04N 21/42202 345/690 |
| 2015/0097880 | A1 * | 4/2015 | Ooga | G09G 3/3406 345/694 |
| 2015/0213766 | A1 * | 7/2015 | Sugimoto | G09G 3/2096 345/690 |
| 2015/0213781 | A1 | 7/2015 | Huang | |
| 2016/0210908 | A1 * | 7/2016 | Seki | G09G 3/3618 |

FOREIGN PATENT DOCUMENTS

| | | | |
|---|---|---|---|
| CN | 102377956 | A | 3/2012 |
| CN | 102708812 | A | 10/2012 |
| CN | 102750912 | A | 10/2012 |
| CN | 105516446 | A | 4/2016 |
| CN | 105869577 | A | 8/2016 |
| CN | 108281125 | A | 7/2018 |
| EP | 1489853 | A2 | 12/2004 |

* cited by examiner

METHOD, APPARATUS, AND DEVICE FOR ADJUSTING BACKLIGHT BRIGHTNESS BASED ON HUMAN EYE CHARACTERISTICS

CROSS-REFERENCE TO RELATED APPLICATIONS

This application is a continuation of International Application No. PCT/CN2018/125292, filed on Dec. 29, 2018, which claims priority to Chinese Patent Application No. 201810012208.3, filed on Jan. 5, 2018, The disclosures of the aforementioned applications are hereby incorporated by reference in their entireties.

TECHNICAL FIELD

Aspects of the present invention relate to the field of image display technologies, and in particular, to a method for dynamically adjusting backlight brightness of a displayed image, an apparatus for dynamically adjusting backlight brightness of a displayed image, and a mobile display device that can dynamically adjust backlight of a displayed image.

BACKGROUND

With development of the information age, mobile electronic devices such as mobile phones and tablet computers have increasingly become an indispensable part of people's life. In addition to factors such as performance and appearance, power consumption (a standby time) is also an important consideration when consumers select mobile products. Therefore, an energy-saving technology for a display screen which is one of the main power-consuming components of a mobile device becomes an important subject of industry research.

Currently, adjustment of screen backlight of a mobile electronic device usually includes two parts. A technology in a first part is an automatic backlight brightness adjustment technology (auto brightness technology). In this technology, backlight is adjusted based on a mapping relationship between ambient light and backlight brightness. To be specific, after a brightness value of the ambient light is detected, the backlight brightness is directly adjusted to a brightness value corresponding to the value, and an adjusted brightness value is optimal screen brightness for viewing by human eyes under the current ambient light. A direct mapping relationship between ambient light brightness and backlight brightness is manually set. A second part is fine adjustment performed based on the backlight brightness adjusted in the first part. A current technology is mainly content adaptive brightness control (CABC). In the CABC technology, an optical sensor is used, so that a host-end processor obtains ambient light brightness information, analyzes content currently displayed on a screen, and further adjusts screen brightness to save power, to further decrease backlight and reduce screen power consumption.

However, the foregoing CABC backlight control manner has a problem. When backlight is decreased for a second time, it is difficult to determine a most appropriate backlight decreasing amplitude. If backlight is excessively decreased, optical compensation is insufficient for compensating for image quality loss, and a user can obviously feel that an image becomes darker; or if backlight is insufficiently decreased, there is still room for decreasing backlight, thereby causing a waste of power, reducing a standby time of an electronic device, and affecting user experience.

SUMMARY

Aspects of this application provide a method for adjusting backlight brightness of a display screen, a device and an apparatus to which the method is applied, and the like, to decrease screen backlight brightness without degrading quality of a displayed image viewed by a user, to save more energy without affecting viewing experience of the user.

According to a first aspect, this application provides a method for adjusting backlight brightness of a display screen, including: obtaining image information of an image currently displayed on a display screen of a device and information about an environment around the device; determining human eye characteristic information based on the information about the environment and the image information, where the human eye characteristic information is related to a minimum magnitude of a brightness change perceptible to human eyes, and the minimum magnitude of a brightness change perceptible to human eyes specifically means that human eyes can sense an obvious change of brightness when a brightness change exceeds the magnitude; obtaining information about the display screen for displaying the current image, and calculating a screen backlight decreasable ratio based on the information about the display screen, the human eye characteristic information, and the image information; determining a screen pixel brightness compensation ratio based on the screen backlight decreasable ratio, and determining an image optical compensation value based on the pixel brightness compensation ratio; decreasing screen backlight brightness based on the screen backlight decreasable ratio; and adjusting a pixel brightness value for the image based on the image optical compensation value. Compared with the prior art, in the method for adjusting backlight brightness, sensitivity of human eyes to a brightness change under different ambient light is considered when the backlight decreasable ratio is calculated, so that an actual brightness decreasing magnitude of a backlight-decreased image can be controlled, through optical compensation for the image, within the minimum magnitude of a brightness change perceptible to human eyes, to decrease backlight without degrading quality of the displayed image, and improve user experience.

Optionally, the determining human eye characteristic information based on the information about the environment and the image information in the method according to the first aspect may be specifically implemented as follows: invoking a human eye characteristic information table, where the table includes a correspondence between information about an environment, image information, and human eye characteristic information, and the table may be determined by a skilled person based on experience or experimental data and pre-stored in a memory of the device, or the table may be pre-stored in a network or another external storage device for invocation; and substituting the information about the environment and the image information into the correspondence to search for human eye characteristic information corresponding to the information about the environment and the image information. Compared with a real-time operation, this determining manner can avoid occupying an extra operation processing resource of the device, and improve device operating efficiency.

Optionally, the image information may include two types of information: current backlight brightness and a histogram of the image. In this case, the image information in the determining human eye characteristic information based on the information about the environment and the image information is the current backlight brightness; and the image information in the calculating of a screen backlight decreasable ratio based on the image information, the information about the display screen, and the human eye characteristic information is the histogram information of the image.

Optionally, in the method according to the first aspect, the determining a screen pixel brightness compensation ratio based on the screen backlight decreasable ratio specifically includes: obtaining the pixel brightness compensation ratio based on the following formula, where in the formula, tempGain is the pixel brightness compensation ratio, and BL ratio is the screen backlight decreasable ratio:

$$tempGain = \frac{255}{BL\ \text{ratio}}^{\frac{1}{2.2}}.$$

The determining the image optical compensation value based on the pixel brightness compensation ratio specifically includes: calculating the optical compensation value by using the following formula, where the optical compensation value is $$\begin{bmatrix} R_{out} \\ G_{out} \\ B_{out} \end{bmatrix},$$

and the initial screen pixel brightness value is $$\begin{bmatrix} R_{in} \\ G_{in} \\ B_{in} \end{bmatrix} : \begin{bmatrix} R_{out} \\ G_{out} \\ B_{out} \end{bmatrix} = \begin{bmatrix} R_{in} \\ G_{in} \\ B_{in} \end{bmatrix} * tempGain.$$

According to a second aspect, this application further provides a device for adjusting screen brightness, where the device includes a main function module, a display module, a backlight brightness control module, and a display drive module. The main function module obtains image information of an image currently displayed on the device, obtains, by using a sensor, information about an environment under which the device displays the image, and determines human eye characteristic information based on the image information and the information about the environment, where the human eye characteristic information is related to a minimum magnitude of a brightness change perceptible to human eyes. The main function module obtains information about a display screen for displaying the current image. The main function module calculates a screen backlight decreasable ratio based on the information about the display screen, the human eye characteristic information, and the image information, determines a screen pixel brightness compensation ratio based on the screen backlight decreasable ratio, and determines an image optical compensation value based on the pixel brightness compensation ratio. The display module is configured to display the image. The backlight brightness control module is configured to adjust, based on the screen backlight decreasable ratio, backlight brightness for the display module to display the image. The display drive module is configured to adjust a pixel brightness value for the image based on the image optical compensation value. Compared with the prior art, in the device for adjusting backlight brightness, sensitivity of human eyes to a brightness change under different ambient light is considered when the backlight decreasable ratio is calculated, so that an actual brightness decreasing magnitude of a backlight-decreased image can be controlled, through optical compensation for the image, within the minimum magnitude of a brightness decreasing change perceptible to human eyes, to decrease backlight without degrading quality of the displayed image, and improve user experience.

Optionally, with reference to the second aspect, in a first possible implementation of the second aspect, the main function module specifically includes an image feature extraction unit, an environment information collection unit, a display screen information obtaining unit, a human eye characteristic information obtaining unit, and a backlight brightness and optical compensation calculation module. The image feature extraction unit is configured to extract the image information. The environment information collection unit is configured to collect, by using the sensor, the information about the environment under which the image is displayed. The human eye characteristic information obtaining unit is configured to determine the human eye characteristic information based on the information about the environment and the image information. The backlight brightness and optical compensation calculation module is configured to: calculate the screen backlight decreasable ratio based on the information about the display screen, the image information, and the human eye characteristic information, determine the screen pixel brightness compensation ratio based on the screen backlight decreasable ratio, and determine the image optical compensation value based on the pixel brightness compensation ratio.

Optionally, with reference to the first possible implementation of the second aspect, in a second possible implementation of the second aspect, the human eye characteristic information obtaining unit is specifically configured to: invoke a human eye characteristic information table, where the table includes a correspondence between information about an environment, image information, and human eye characteristic information, and the correspondence may be obtained through an experiment; and search for corresponding human eye characteristic information based on the information about the environment, the image information, and the correspondence.

Optionally, with reference to the first or the second possible implementation of the second aspect, in a third possible implementation of the second aspect, the image information includes both current backlight brightness and histogram information of the image. The image information based on which the human eye characteristic information obtaining unit determines the human eye characteristic information is the current backlight brightness, and the image information based on which the backlight brightness and optical compensation calculation module determines the screen backlight decreasable ratio is the histogram information of the image.

Optionally, with reference to the first to the third possible implementations of the second aspect, in a fourth possible implementation of the second aspect, the backlight brightness and optical compensation calculation module obtains the pixel brightness compensation ratio based on the following formula, where in the formula, tempGain is the pixel brightness compensation ratio, and BL ratio is the screen backlight decreasable ratio:

$$tempGain = \frac{255}{BL\ \text{ratio}}^{\frac{1}{2.2}}.$$

The determining the image optical compensation value based on the pixel brightness compensation ratio specifically includes: calculating the optical compensation value by using the following formula, where the optical compensation value is $$\begin{bmatrix} R_{out} \\ G_{out} \\ B_{out} \end{bmatrix},$$

and the initial screen pixel brightness value is $$\begin{bmatrix} R_{in} \\ G_{in} \\ B_{in} \end{bmatrix} : \begin{bmatrix} R_{out} \\ G_{out} \\ B_{out} \end{bmatrix} = \begin{bmatrix} R_{in} \\ G_{in} \\ B_{in} \end{bmatrix} * tempGain.$$

According to a third aspect, this application further provides an apparatus for adjusting screen brightness, including one or more ports and a processor. The one or more ports are configured to transmit information, and may be a physical port or a virtual port. The processor obtains, by using one or more of the foregoing ports, image information of a currently displayed image, information about an environment, and information about a display screen, and determines human eye characteristic information based on the information about the environment and the image information, where the human eye characteristic information is related to a minimum magnitude of a brightness change perceptible to human eyes. The processor calculates a screen backlight decreasable ratio based on the information about the display screen, the image information, and the human eye characteristic information, determines a screen pixel brightness compensation ratio based on the screen backlight decreasable ratio, and determines an image optical compensation value based on the pixel brightness compensation ratio. The apparatus for adjusting screen brightness applies the screen backlight decreasable ratio and the image optical compensation value to image display control. Compared with the prior art, in the apparatus for adjusting backlight brightness, sensitivity of human eyes to a brightness change under different ambient light is considered when the backlight decreasable ratio is calculated, so that an actual brightness decreasing magnitude of a backlight-decreased image can be controlled, through optical compensation for the image, within the minimum magnitude of a brightness decreasing change perceptible to human eyes, to decrease backlight without degrading quality of the displayed image, and improve user experience.

Optionally, the apparatus for adjusting screen brightness may further include a sensor, a power management circuit, a display drive circuit, and a display screen. The sensor is configured to collect the information about the environment, and transmit the information about the environment to the processor by using the port. The information about the environment may be one or both of brightness or color temperature of ambient light. The power management circuit is configured to control backlight brightness of the display screen according to an instruction that is sent by the processor and that is related to the backlight decreasable ratio. The display drive circuit is configured to perform digital-to-analog conversion on the received image optical compensation value, and accordingly, adjust a pixel brightness value for displaying the image. The display screen is configured to display the image based on received information.

Optionally, a process of determining the human eye characteristic information by the apparatus for adjusting brightness is specifically: invoking a human eye characteristic information table that includes a correspondence between information about an environment, image information, and human eye characteristic information, and substituting the information about the environment and the image information into the correspondence to search for corresponding human eye characteristic information.

Optionally, the image information may be one or both of current backlight brightness or a histogram of the currently displayed image. When the image information includes two types of information: the current backlight brightness and the histogram information of the image, the image information based on which the human eye characteristic information is determined is the current backlight brightness, and the image information based on which the screen backlight decreasable ratio is calculated is the current backlight brightness and the histogram information.

Optionally, the processor obtains the pixel brightness compensation ratio based on the following formula, where in the formula, tempGain is the pixel brightness compensation ratio, and BL ratio is the screen backlight decreasable ratio:

$$tempGain = \frac{255}{BL\ \text{ratio}}^{\frac{1}{2.2}}.$$

The determining the image optical compensation value based on the pixel brightness compensation ratio specifically includes: calculating the optical compensation value by using the following formula, where the optical compensation value is $$\begin{bmatrix} R_{out} \\ G_{out} \\ B_{out} \end{bmatrix},$$

and the initial screen pixel brightness value is $$\begin{bmatrix} R_{in} \\ G_{in} \\ B_{in} \end{bmatrix} : \begin{bmatrix} R_{out} \\ G_{out} \\ B_{out} \end{bmatrix} = \begin{bmatrix} R_{in} \\ G_{in} \\ B_{in} \end{bmatrix} * tempGain.$$

According to a fourth aspect, this application provides a nonvolatile readable storage medium. The medium stores an instruction that instructs a processor to perform a method for adjusting screen brightness. When the instruction runs on a display apparatus, the apparatus can be enabled to implement the method and the specific implementations of the method in the first aspect of this application. Specifically, when the instruction runs on a processor, the processor can be enabled to perform the following operations: obtaining image information of an image currently displayed on a display device, collecting, by using a sensor, information about an environment under which the image is displayed, and determining human eye characteristic information based on the information about the environment and the image information, where the human eye characteristic information is related to a minimum magnitude of a brightness change perceptible to human eyes; obtaining information about a display screen configured to display the image, and calculating a screen backlight decreasable ratio based on the information about the display screen, the image information, and the human eye characteristic information; and calculating an image optical compensation value based on the screen backlight decreasable ratio, and applying the screen backlight decreasable ratio and the image optical compensation value to image display control. The human eye characteristic information is used to determine that an actual brightness change magnitude of the screen is less than a minimum magnitude of a brightness decreasing change perceptible to human eyes, after brightness of the screen is adjusted based on the backlight decreasable ratio and the image optical compensation value.

Optionally, in the method for adjusting screen brightness that the instruction stored in the nonvolatile readable storage medium instructs the processor to perform, the determining human eye characteristic information based on the information about the environment and the image information includes: first, invoking a human eye characteristic information table that includes a correspondence between information about an environment, image information, and human eye characteristic information, and substituting the information about the environment and the image information into the correspondence to search for corresponding human eye characteristic information.

Optionally, in the method for adjusting screen brightness that the instruction stored in the nonvolatile readable storage medium instructs the processor to perform, a specific method for calculating the optical compensation value is as follows:

defining the optical compensation value as tempGain, and defining the screen backlight decreasable ratio as BL ratio:

$$tempGain = \frac{255}{BL\ \text{ratio}}^{\frac{1}{2.2}};$$

and the determining the image optical compensation value based on the pixel brightness compensation ratio specifically includes: calculating the optical compensation value by using the following formula, where the optical compensation value is $$\begin{bmatrix} R_{out} \\ G_{out} \\ B_{out} \end{bmatrix},$$

and the initial screen pixel brightness value is $$\begin{bmatrix} R_{in} \\ G_{in} \\ B_{in} \end{bmatrix}; \begin{bmatrix} R_{out} \\ G_{out} \\ B_{out} \end{bmatrix} = \begin{bmatrix} R_{in} \\ G_{in} \\ B_{in} \end{bmatrix} * tempGain.$$

The solutions for adjusting screen brightness and the specific implementations of the solutions in the foregoing aspects of this application may be used to further adjust brightness after a screen is adjusted by using an automatic backlight brightness adjustment technology. In the automatic backlight brightness adjustment technology, backlight is adjusted based on a mapping relationship between ambient light and backlight brightness. To be specific, after a brightness value of the ambient light is detected, the backlight brightness is directly adjusted to a brightness value corresponding to the value, and an adjusted brightness value is optimal screen brightness for viewing by human eyes under the current ambient light. Therefore, the solutions for adjusting screen brightness and the implementations of the solutions can be applied after automatic backlight brightness adjustment, to further save energy based on brightness with the human eye characteristic information considered. This further saves energy without affecting viewing experience of human eyes on an image.

In the solutions for adjusting screen brightness and the specific implementations of the solutions in the foregoing aspects of this application, the image information may be one or more of backlight brightness or histogram information of the current image, or any other brightness information related to the current image; the information about the environment may be one or more of brightness or color temperature of ambient light, or any other information related to the ambient light; the information about the display screen may be one or more of maximum brightness, minimum brightness, or color gamut that can be displayed on the display screen, or any other information related to a display capability of the display screen.

The method for adjusting backlight brightness and the specific implementation solutions of the method in this application may be applied to a device that uses block-based brightness control for a screen. Specifically, each screen sub-block may be separately adjusted by using the method during backlight brightness adjustment.

BRIEF DESCRIPTION OF DRAWINGS

To describe the technical solutions provided in this application more clearly, the following briefly describes the accompanying drawings. The accompanying drawings in the following description show only some embodiments of this application.

DESCRIPTION OF EMBODIMENTS

Figure 1:
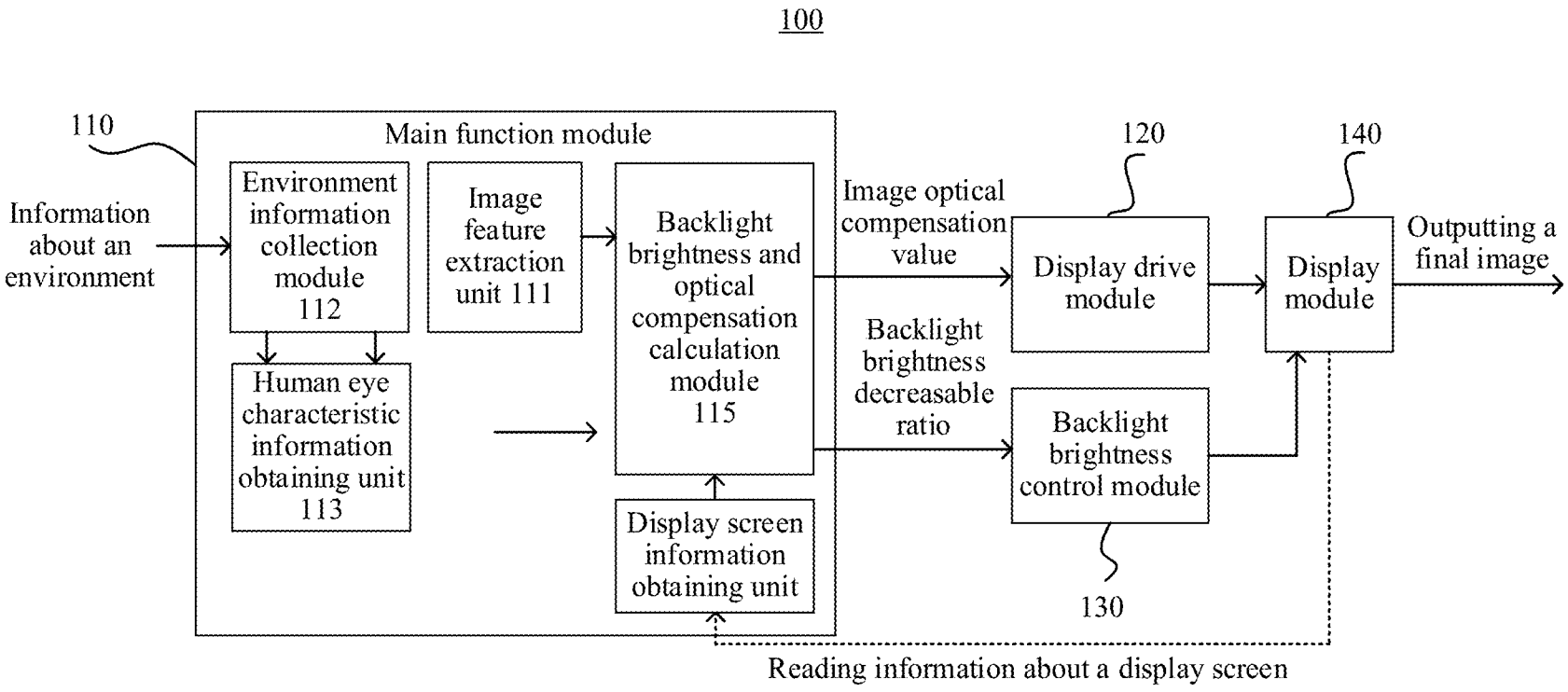
FIG. 1 is a schematic logical structural diagram of a function module of an apparatus for adjusting screen backlight brightness.

To easily understand the embodiments of this application, some elements used in description of the embodiments of this application are first described herein. It should be noted that the following descriptions of elements do not constitute a limitation on the technical solutions of this application.

CABC: Content adaptive backlight control is an existing backlight adjustment technology for controlling global backlight based on a display environment and display content to reduce power consumption. Currently, the CABC is mainly applied to a mobile device such as a mobile phone.

LCD display: A liquid-crystal display (liquid-crystal display, LCD) is a flat thin display device, and includes two parts: a display screen and a light source. The display screen consists of a specific quantity of color or black-and-white pixels, and is placed in front of the light source.

AMOLED display: An active-matrix organic light-emitting diode (AMOLED) is a display screen technology. This type of display does not have an independent light source, but achieves brightness through self-luminescence of a display screen.

Histogram information: An image histogram is a histogram used to represent brightness distribution in a digital image, and depicts a quantity of pixels of each brightness value in the image. How the brightness distribution needs to be adjusted may be learned through observation of the histogram. In the histogram, a left side of a horizontal coordinate is a pure black and relatively dark region, and a right side of the horizontal coordinate is a relatively bright and pure white region. Therefore, data in an image histogram of a relatively dark image is mostly concentrated in left and middle parts, and a case for a generally bright image with only a few shadows is opposite, data in the generally bright image with only a few shadows histogram of a relatively bright image is mostly concentrated in a right part.

RGB value: An RGB color model, also referred to as a red-green-blue color model, is an additive color model, in which color light of red, green, and blue colors are added up at different ratios, to produce a variety of color light. Currently, in computer hardware, each pixel is represented by 24 bits (bit). Therefore, eight bits are allocated to light of each of the RGB colors. Intensity of each of the RGB colors is divided into 256 values based on a highest value of 28 for eight bits. The values are RGB values. Values of each of the RGB colors range from 0 to 255 from the darkest to the brightest.

Bin: Color space needs to be divided into several small color intervals for calculating a color histogram. Each small interval is a bin of the histogram. This process is referred to as color quantization. There are many methods for color quantization, for example, vector quantization, a clustering method, or a neural network method. A most commonly used method is to evenly divide components (dimensions) of color space, that is, evenly divide an RGB interval (0 to 255) into several bins.

Backlight brightness: Backlight brightness is light source brightness of a screen in this application. The backlight brightness is usually light source brightness of a backlight-illuminated screen (such as an LCD), and a concept of "backlight" is usually not used for a self-luminous screen (such as an AMOLED). For ease of description, the "backlight brightness" described in this application includes self-luminous brightness of a self-luminous screen.

The following clearly describes the technical solutions in the embodiments of the present invention with reference to the accompanying drawings in the embodiments of the present invention.

A screen energy saving technology in this application may be applied to a mobile device such as a mobile phone or a tablet computer. Usually, a CABC backlight brightness adjustment technology is used for the foregoing device to reduce power consumption. The embodiments of the present invention propose a new solution based on an apparatus for adjusting screen brightness in FIG. 1. When a backlight decreasing magnitude is calculated, a characteristic of sensing a brightness change by human eyes is considered, to decrease backlight brightness to a maximum extent without decreasing actual brightness of an image viewed by human eyes.

The screen energy-saving apparatus, technology, and application scenario described in the embodiments of this application are intended to describe the technical solutions in the embodiments of this application more clearly, and do not constitute a limitation on the technical solutions provided in the embodiments of this application. A person skilled in the art may know that with a change of an application scenario, the technical solutions provided in the embodiments of this application are also applicable to similar technical problems.

A method and an apparatus for implementing this application are described below in a more detailed manner with reference to the accompanying drawings. It should be noted that postpositive terms "unit" and "module" are merely for ease of description, and these postpositive terms do not have a meaning or function that is distinguished from each other. The method provided in this application may be implemented by using hardware or software.

FIG. 1 is a schematic structural diagram of an embodiment of an apparatus for adjusting screen brightness according to the present invention. As shown in FIG. 1, the apparatus 100 for adjusting brightness includes a main function module 110, a display drive module 120, a brightness control module 130, and a display module 140. The main function module 110 includes an image feature extraction unit 111, an environment information collection module 112, a human eye characteristic information obtaining unit 113, a display screen information obtaining unit 114, and a backlight brightness and optical compensation calculation module 115.

The main function module 110 obtains required information, and calculates a backlight brightness decreasing magnitude and an image optical compensation ratio. The display screen information obtaining unit 114 may directly read information about a display screen from the display module 140, and transmit the information about the display screen to the backlight brightness and optical compensation calculation module 115. The information about the display screen is implemented as minimum brightness and maximum brightness of a screen in this embodiment. Optionally, alternatively, the information about the display screen may be directly stored in a storage medium, and does not need to be read from the display module 140 in real time. The image feature extraction unit 111 extracts image information. The image information is implemented as a histogram and backlight brightness of a currently displayed image in this embodiment, and is usually stored in an image processor. The environment information collection module 112 is implemented as a photosensitive sensor in this embodiment, and is configured to collect ambient light brightness information. Optionally, the environment information collection module may also be configured to collect information such as color temperature of ambient light. The human eye characteristic information obtaining unit 113 obtains human eye characteristic information by using the received information about the environment and image information, and sends the human eye characteristic information to the backlight brightness and optical compensation calculation module 115. A possible manner of obtaining the human eye characteristic information is looking up a table, where the table includes a correspondence between information about an environment, image information, and human eye characteristic information. In this embodiment, the correspondence is a correspondence between ambient light brightness, the backlight brightness of the currently displayed image, and the human eye characteristic information. For a specific implementation, refer to descriptions of step S321 in an embodiment related to FIG. 3.

After obtaining the information about the display screen, the image information, and the human eye characteristic information, the backlight brightness and optical compensation calculation module 115 calculates a backlight brightness decreasable ratio and an optical compensation value. For a specific calculation process, refer to descriptions of step S330 in the embodiment related to FIG. 3. Then the backlight brightness and optical compensation calculation module 115 sends the optical compensation value to the display drive module 120, and the display drive module performs digital-to-analog conversion on received information, and sends information obtained through digital-to-analog conversion to the display module 140. In addition, the backlight brightness and optical compensation calculation module 115 sends the backlight brightness decreasable ratio to the backlight brightness control module 130, and the backlight brightness control module controls, based on the backlight brightness decreasable ratio, the display module 140 to decrease backlight brightness.

In this way, finally, an RGB value of an image output by the display module 140 is increased, the backlight brightness is decreased, and an actual display brightness decreasing magnitude is less than a minimum magnitude of brightness decreasing perceptible to human eyes. This reduces power consumption without degrading quality of an image received by a user.

A function of the main function module may be implemented by at least one of electronic units such as an application-specific integrated circuit (ASIC), a digital signal processor (DSP), a programmable logic device (PLD), a field programmable gate array (FPGA), a processor, a controller, a microcontroller, and/or a microprocessor, or may be implemented by a software module that performs at least one function or operation. The software module may be implemented by using a software program compiled by using any appropriate software language. The software program may be stored in a memory in a mobile device or a network, and is read and executed by a processor.

Optionally, the embodiment may further include a block control module (not shown in the figure), configured to control and coordinate display of each screen sub-block on a terminal device that uses block-based brightness control for a screen. Specifically, when controlling a screen sub-block, the block control module controls the image feature extraction unit 111 to extract image information of the current sub-block, and sends the image information of the current sub-block to the backlight brightness and optical compensation calculation module 115 for calculating a backlight brightness decreasable ratio and an image optical compensation value of the current sub-block, where the backlight brightness decreasable ratio and the image optical compensation value are used to adjust backlight brightness and screen pixel brightness of the screen sub-block respectively.

Figure 2:
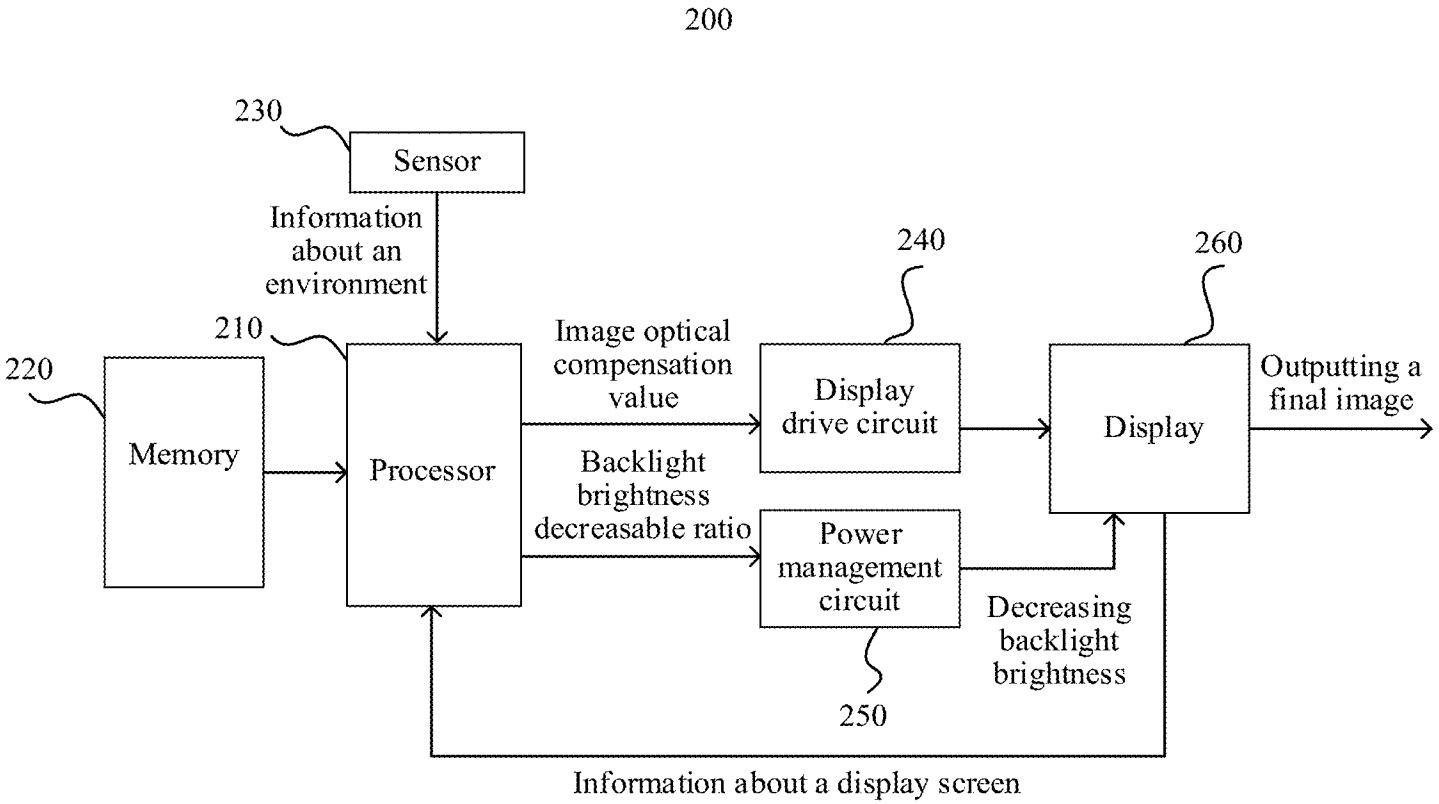
FIG. 2 is a schematic logical structural diagram of hardware of an apparatus for adjusting screen backlight brightness.

FIG. 2 is a schematic structural diagram of another embodiment of an apparatus for adjusting screen brightness according to the present invention. The apparatus 200 for adjusting screen brightness includes a processor 210, a memory 220, a sensor 230, a display drive circuit 240, a power management circuit 250, and a display 260.

The processor 210 may include one or more processors. For example, the processor 210 may include one or more central processing units, or include one central processing unit and one graphics processing unit. When the processor 210 includes a plurality of processors, the plurality of processors may be integrated on a same chip, or may each be an independent chip.

The graphics processing unit is responsible for conventional image processing, and may be included in a chip, or may exist independently.

The memory 220 may be one or more of the following types: a flash (flash) memory, a memory of a hard disk type, a memory of a micro multimedia card type, a card-type memory (for example, a secure-digital (SD) or extreme-digital (XD memory), a random access memory (RAM), a static random access memory (SRAM), a read-only memory (ROM), an electrically erasable programmable read-only memory (EEPROM), a programmable read-only memory (PROM), or a magnetic memory.

In some other embodiments, the memory 220 may be a network storage device on the internet, and the terminal device 200 may perform an update operation, a read operation, or the like on the memory 220 on the internet.

The sensor 230 may sense information about an environment around a device, for example, luminance and color temperature of ambient light. In this embodiment, the sensor may be implemented as a photosensitive sensor.

The display drive circuit 240 may perform digital-to-analog conversion on information received from the processor, and send information obtained through digital-to-analog conversion to the display for displaying.

The power management circuit 250 adjusts backlight brightness of a display screen based on information received from the processor. Specifically, in an LCD display, the power management circuit adjusts a voltage applied to a backlight source, to adjust brightness of the display; and in an AMOLED display, the power management circuit adjusts a voltage applied to a display screen, to directly change self-luminous brightness of the display screen.

The display 260 displays an image based on received information, and may be specifically implemented as an LCD display, or may be implemented as an AMOLED display.

When the device is operating, the sensor 230 collects information about an environment around the display device, and transmits the information about the environment to the processor 210. In this embodiment, the information about the environment is ambient light brightness. The processor 210 invokes image information of a currently displayed image from the graphics processing unit, where the image information is backlight brightness information and histogram information of the currently displayed image in this embodiment. In addition, the processor 210 receives the information about the environment from the sensor 230; invokes, from the memory 220, a table that includes a correspondence between information about an environment, image information, and human eye characteristic information; and substitutes the information about the environment and the image information into the table to obtain human eye characteristic information. In this embodiment, the information about the environment in the table is the ambient light brightness, and the image information in the table is the backlight brightness of the currently displayed image. The processor looks up the table based on the received ambient light brightness information and image backlight brightness information, to obtain corresponding human eye characteristic information. For a specific implementation, refer to descriptions of step S321 in an embodiment related to FIG. 3. In addition, the processor 210 further obtains information about a display screen from the display 260. Optionally, the information about the display screen may be alternatively pre-stored in the memory 220 for invocation by the processor 210.

Then, the processor 210 calculates a backlight brightness decreasable ratio and an image optical compensation value based on the image information, the information about the display screen, and the human eye characteristic information, sends the image optical compensation value to the display drive circuit 240, and sends the backlight brightness decreasable ratio to the power management circuit 250. For a specific process of calculating the backlight brightness decreasable ratio and the image optical compensation value, refer to descriptions of step S330 in the embodiment related to FIG. 3.

After receiving the image optical compensation value sent by the processor 210, the display drive circuit 240 performs digital-to-analog conversion on the image optical compensation value, and sends a value obtained through digital-to-analog conversion to the display 260. The display 260 displays an image based on received information.

After receiving the backlight brightness decreasable ratio sent by the processor 210, the power management circuit 250 adjusts a light source voltage of the display, and correspondingly adjusts backlight brightness. In an LCD display, the power management circuit 250 adjusts a voltage of a backlight source through pulse width modulation (Pulse Width Modulation, PWM) or linear light adjustment, to adjust backlight brightness. In an AMOLED display, the power management circuit 250 adjusts a voltage of a display screen based on a voltage-brightness conversion model, to change backlight brightness.

Finally, the display 260 displays a final image based on received information.

In still another embodiment of the present invention, the apparatus 200 for adjusting screen brightness may further include a block brightness control function. The processor 210, the display drive circuit 240, the power management circuit 250, and the display 260 each may include a corresponding function required for screen block brightness control. Specifically, the display 260 includes a plurality of screen sub-blocks, and each sub-block independently performs image display and backlight control. The processor 210 may invoke image information of a current sub-block from the graphics processing unit, and the display drive circuit 240 can perform digital-to-analog conversion on information of different screen sub-blocks separately and output information obtained through digital-to-analog conversion to a corresponding sub-block of the display 260. The power management circuit 250 may separately adjust, according to an instruction, backlight brightness applied to any sub-block of the display 260.

Figure 3:
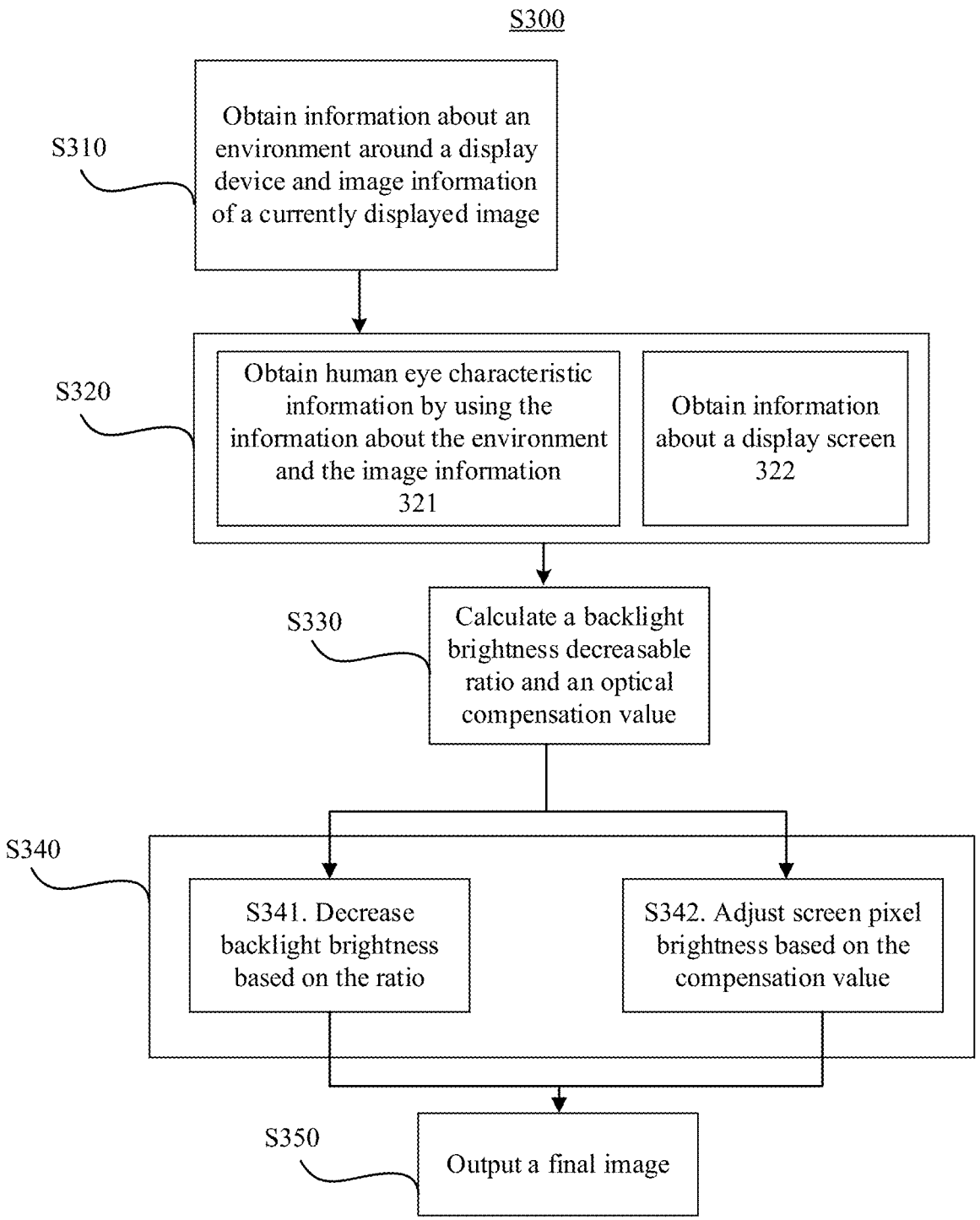
FIG. 3 is a schematic flowchart of a method for adjusting screen backlight brightness.

FIG. 3 is a schematic flowchart of an embodiment of a method for adjusting screen brightness according to the present invention.

The method for adjusting screen brightness includes the following process.

S310. Obtain information about an environment around a display device and image information of a currently displayed image; the information includes image information of a currently displayed image and information about an environment under which the image is displayed. In this embodiment, the information about the environment is implemented as ambient light brightness. A sequence for obtaining the information is not limited.

S320. Obtain information required for calculating a backlight brightness decreasable ratio and an image optical compensation value; determine human eye characteristic information based on the information about the environment and the image information, where the human eye characteristic information is related to a minimum magnitude of a brightness change perceptible to human eyes; and obtain information about a display screen for displaying the image.

First, in S321, the human eye characteristic information N is determined based on the information about the environment and the image information. A specific determining manner is as follows:

The minimum magnitude of a brightness change perceptible to human eyes is defined as a just noticeable level (JDL), with a value of dL.

N JDLs can always be found in any given brightness interval (Lmin, Lmax), where N is the human eye characteristic information. n is defined as a positive integer from 1 to N, and dLn is defined as an $n^{th}$ dL. In this case, a physical meaning of N may be expressed as follows:

$$L\max = L\min + \Sigma_{N=1}^{N} dLn.$$

Figure 6A:
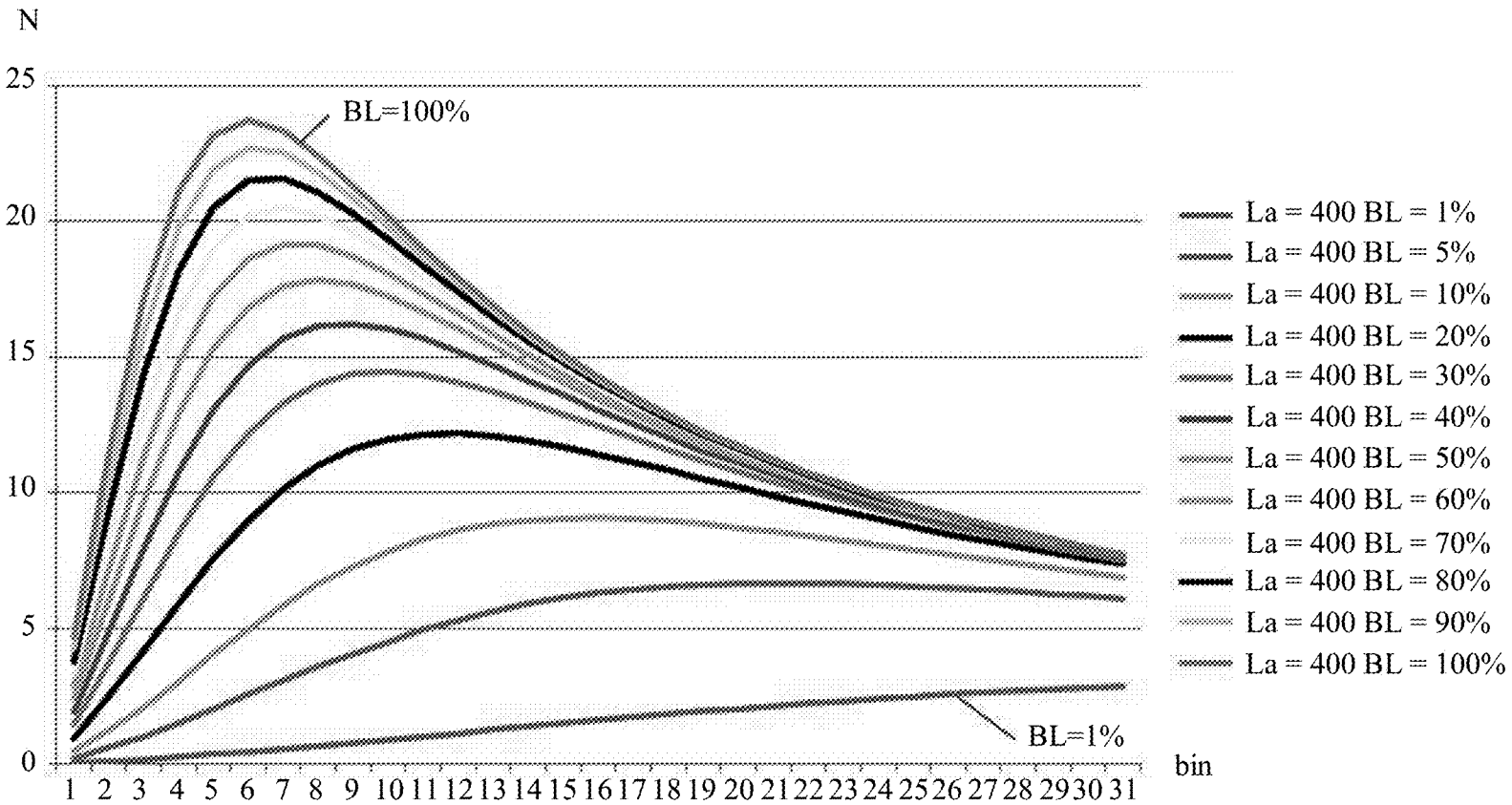
FIG. 6*a* shows N-values in different bin intervals under different backlight brightness BL when ambient light brightness La is constant.
Figure 6B:
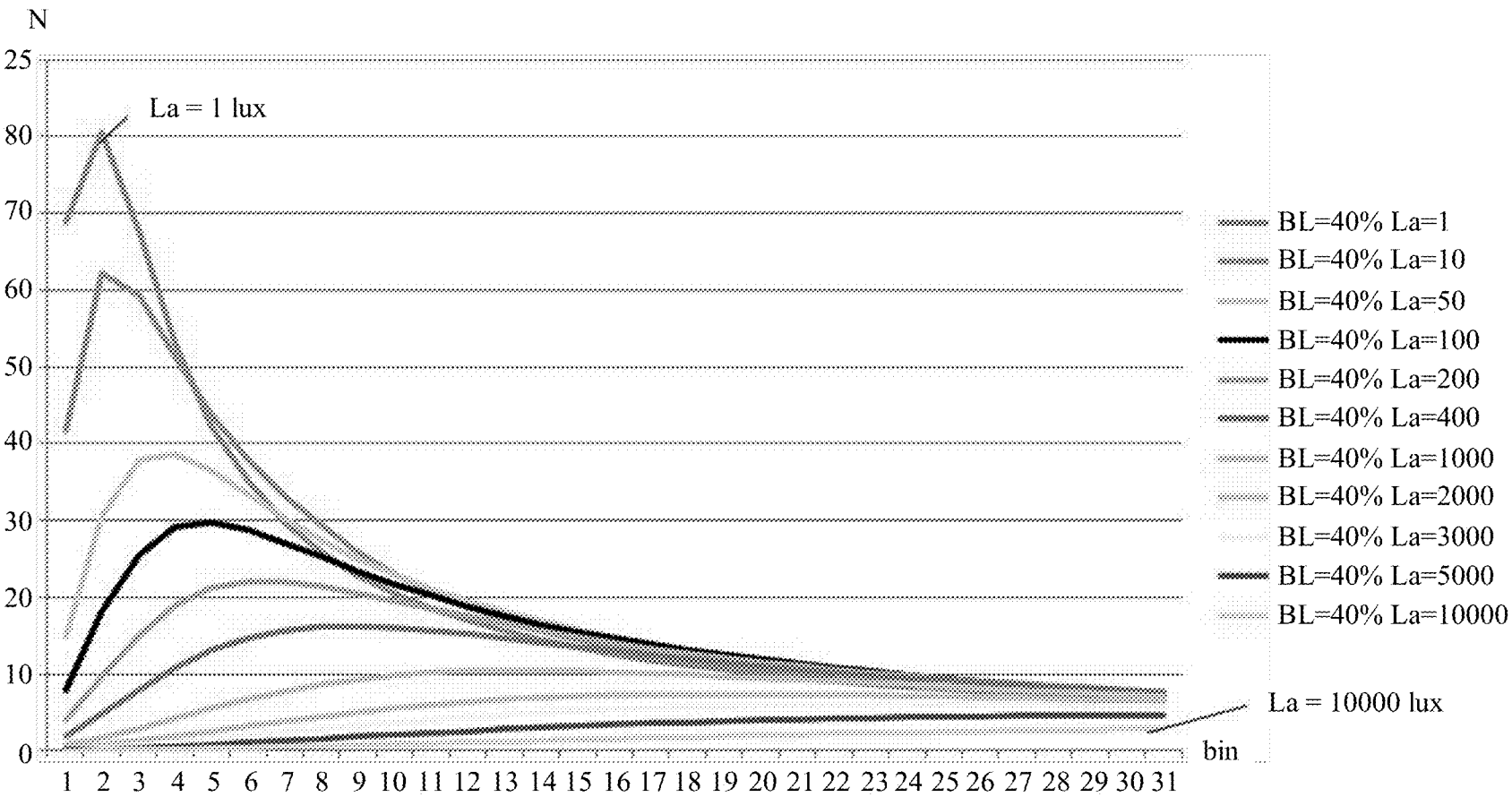
FIG. 6*b* shows N-values in different bin intervals under different ambient light brightness La when backlight brightness BL is constant.

N(m) is defined as a total quantity of JDLs accommodated within an interval of bin(m), where m is a natural number. Ambient light brightness is defined as La, and backlight brightness of a device is defined as BL. A correspondence between N(m), La, and BL in an entire pixel brightness interval may be obtained through an experiment. FIG. 6*a* and FIG. 6*b* show a possible correspondence reference table. FIG. 6*a* shows N-values in different bin intervals under different backlight brightness BL when ambient light brightness La is constant. FIG. 6*b* shows N-values in different bin intervals under different ambient light brightness La when backlight brightness BL is constant. In this embodiment, a corresponding value of the human eye characteristic information N(m) in bin(m) may be obtained by substituting the ambient light brightness La and the backlight brightness BL into the correspondence.

In addition, in S322, a main function module obtains the information about the display screen and the image information. Specifically, in this embodiment, the main function module obtains minimum brightness black_level that can be displayed on the display screen.

Figure 4:
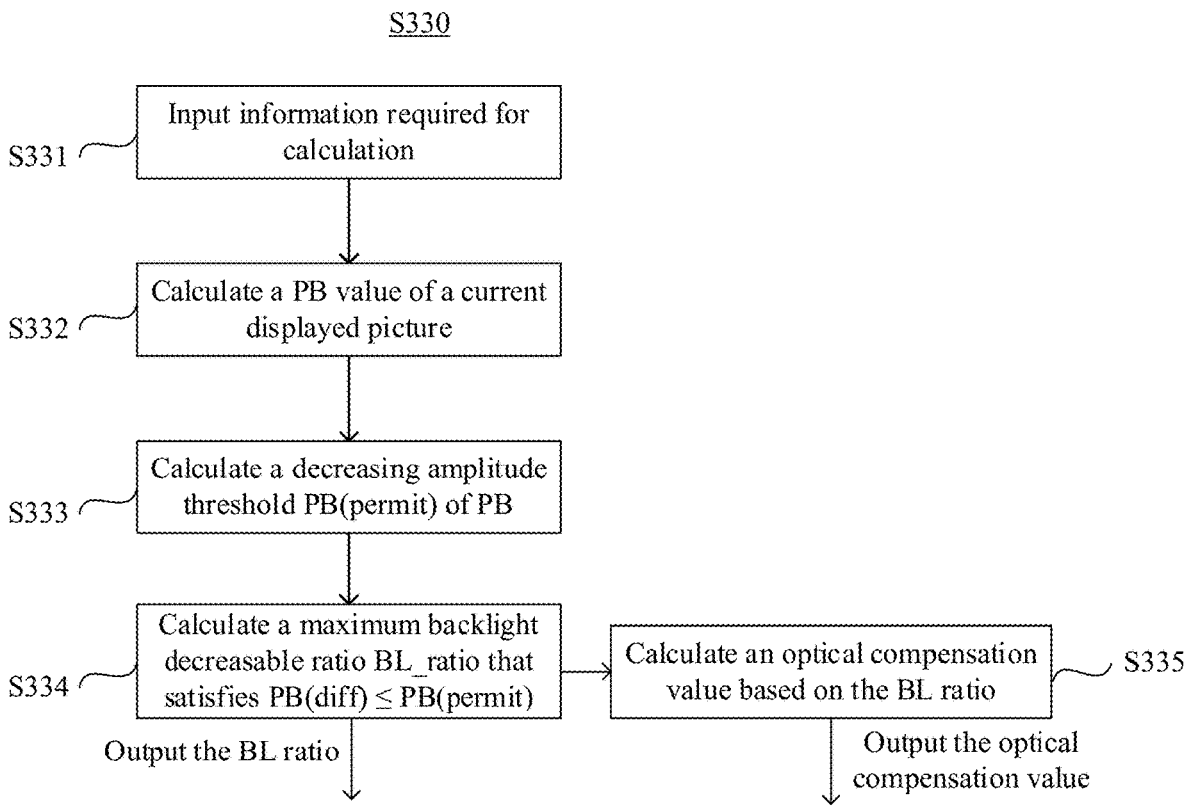
FIG. 4 is a schematic flowchart of a process of calculating a screen backlight decreasable ratio in a method for adjusting screen backlight brightness.

After obtaining the required information, the main function module 110 proceeds to S330. Calculate the screen backlight decreasable ratio based on the information about the display screen (the minimum brightness that can be displayed on the display screen), the image information (backlight brightness information and histogram information of the currently displayed image), and the human eye characteristic information N(m), and determine the image optical compensation value based on a pixel brightness compensation ratio. For a specific calculation process, refer to FIG. 4.

S331. First, input the image information of the currently displayed image to the backlight brightness and optical compensation calculation module 115, where the image information includes: backlight brightness information peak_level and histogram information of the currently displayed image, where a maximum pixel brightness interval (0-255) is divided into i bins in the histogram information, and i is a natural number; the human eye characteristic information N(m); and the information about the display screen Black_level.

S332. Define PB as a parameter representing screen brightness:

$$PB = \sum_{m=1}^{i} N(m) * P(m)$$

where m is a natural number from 1 to i, and P(m) is a quantity of pixels of the currently displayed image in bin(m), and may be directly obtained by querying the histogram information.

Obtain a PB value of the current image.

S333. Define PB(diff) as a variation of PB after the backlight brightness peak_level is decreased: PB(diff)=PB'−PB, where PB' is a PB value obtained after the backlight is decreased.

Define PB(permit) as a critical value of a PB decrease that is allowed due to a decrease of the backlight peak_level, that is, a maximum value of PB(diff). A possible determining manner is: PB(permit)=min(N[i]*0.05, 0).

S334. Calculate and output a maximum backlight decreasable ratio BL_ratio that satisfies PB(diff)≤PB(permit).

S335. Calculate the image optical compensation value $$\begin{bmatrix} R_{out} \\ G_{out} \\ B_{out} \end{bmatrix}$$

based on BL_ratio.

First, calculate an image optical compensation ratio tempGain. tempGain is a ratio by which screen pixel brightness needs to be changed:

$$tempGain = \frac{255}{BL\ \text{ratio}}^{\frac{1}{2.2}}.$$

Then, calculate and output the image optical compensation value $$\begin{bmatrix} R_{out} \\ G_{out} \\ B_{out} \end{bmatrix}$$

based on the image optical compensation ratio tempGain. Details are as follows:

$$\begin{bmatrix} R_{out} \\ G_{out} \\ B_{out} \end{bmatrix} = \begin{bmatrix} R_{in} \\ G_{in} \\ B_{in} \end{bmatrix} * tempGain$$

where $$\begin{bmatrix} R_{in} \\ G_{in} \\ B_{in} \end{bmatrix}$$

in is an initial screen pixel brightness value before the backlight is decreased.

S340. Execute calculation results. To be specific, decrease, based on the screen backlight decreasable ratio, screen backlight brightness for displaying the image on the screen, and adjust a pixel brightness value for the image based on the image optical compensation value. Details are as follows. S341. Send information about the maximum backlight decreasable ratio BL_ratio to the backlight brightness control module 130, to change backlight brightness. S342. Send information about the image optical compensation value $$\begin{bmatrix} R_{out} \\ G_{out} \\ B_{out} \end{bmatrix}$$

to the display drive module 120 for digital-to-analog conversion. The display drive module 120 sends data obtained through digital-to-analog conversion to the display module 140 for application.

S350. Output a final image, that is, display the image based on decreased screen backlight brightness and an adjusted pixel brightness value. The display module 140 outputs the final image by combining decreased backlight and a compensated image.

Figure 5:
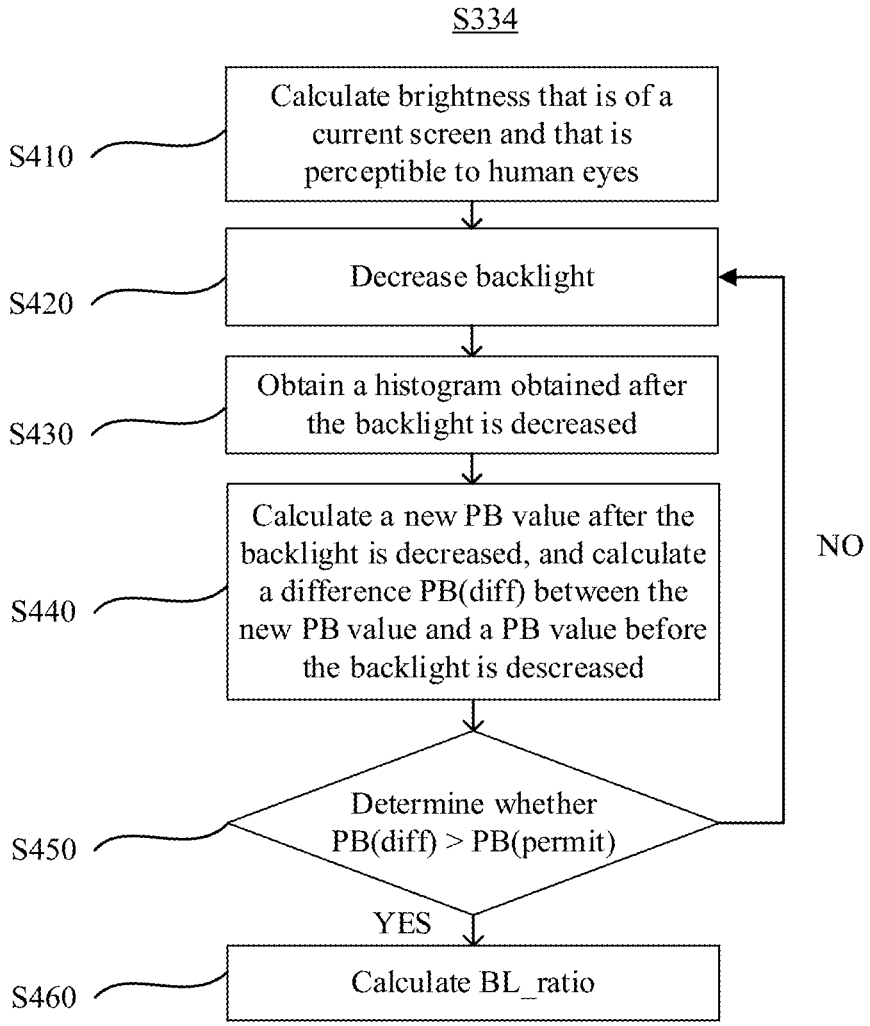
FIG. 5 is a schematic flowchart of an iteration process of calculating a maximum screen backlight decreasable ratio in a process of calculating a screen backlight decreasable ratio in a method for adjusting screen backlight brightness.

As shown in FIG. 5, a process of calculating the maximum backlight decreasable ratio BL_ratio is as follows.

S410. Calculate, by using an electro-optical transfer function (Electro-Optical Transfer Function, EOTF) formula, screen display brightness before the backlight is decreased. Define brightness(m) as a screen display brightness value perceptible to human eyes in an $m^{th}$ bin, black_level as the information about the display screen, that is, the minimum brightness that can be displayed on the screen, peak_level as the image information, that is, current backlight brightness, and pixel value(m) as average pixel brightness in the $m^{th}$ bin. pixel_value may be obtained through lookup in a histogram. A specific calculation formula is as follows:

$$\text{brightness}\ (m) = \text{black level} + \text{peak level1} * \left(\frac{\text{pixel value (m)}}{256}\right)^{2.2}.$$

S420. Decrease backlight. It is assumed that the backlight decreases by X nit for a single time, that is, peak level decreases by X nit.

S430. Calculate, by using an optical-electro transfer function (Optical-Electro Transfer Function, OETF), a corresponding pixel value(m)* at a decreased peak level*. A specific formula is as follows:

$$\text{pixel value}\ (m)^* = 255 * \left(\frac{\text{luminance value}\ (m) - \text{black level}}{\text{peak level}^*}\right)^{\frac{1}{2.2}}$$

New pixel values corresponding to m bins after the backlight is decreased are successively calculated according to the foregoing manner, and remapping is performed based on a current histogram arrangement to obtain a new histogram.

S440. Calculate a new PB after the backlight is decreased, and calculate a difference between the new PB and a PB that exists before the backlight is decreased, to obtain PB(diff).

S450. Determine whether PB(diff)>PB(permit) is true. If PB(diff)>PB(permit) is false, return to step S420 to perform an iteration process again; or if PB(diff)>PB(permit) is true, exit an iteration process, and record total screen brightness decreased in the previous iteration process. To be specific, if the iteration process ends at an $n^{th}$ iteration, a final brightness decreasing value is (n−1)X nit, and an iteration operation ends.

S460. Calculate an actual decreasable ratio BL ratio:

$$\text{BL_ratio} = \frac{(n-1)X}{\text{peak_level}}.$$

In one or more embodiments, the described functions may be implemented by hardware, software, firmware, or any combination thereof. If the functions are implemented by software, the functions may be stored in a computer readable medium as one or more instructions or code lines, or sent by a computer readable medium, and are executed by a hardware-based processing unit. The computer readable medium may include a computer readable storage medium (which is corresponding to a tangible medium such as a data storage medium) or a communications medium, and the communications medium includes, for example, any medium that promotes transmission of a computer program from one place to another place according to a communications protocol. In this manner, the computer readable medium may be generally corresponding to: (1) a non-transitory tangible computer readable storage medium, or (2) a communications medium such as a signal or a carrier. A data storage medium may be accessed by one or more computers or one or more processors to retrieve an instruction, code, and/or a data structure for implementing any available medium in technologies described in the present invention. A computer program product may include a computer readable medium.

By way of example and instead of limitation, some computer readable storage media may include a RAM, a ROM, an EEPROM, a CD-ROM, another optical disc storage or magnetic disk storage, another magnetic storage apparatus, a flash memory, or any other medium that can store required program code in a form of an instruction or a data structure and can be accessed by a computer.

An instruction may be executed by one or more processors such as one or more digital signal processors (DSP), a general microprocessor, an application-specific integrated circuit (ASIC), a field programmable gate array (FPGA), or an equivalent integrated circuit or discrete logic circuits. Therefore, the term "processor" used in this specification may refer to the foregoing structure, or any other structure that may be applied to implementation of the technologies described in this specification.

It should be understood that "one embodiment" or "an embodiment" mentioned in the whole specification does not mean that particular features, structures, or characteristics related to the embodiment are included in at least one embodiment of the present invention. Therefore, "in one embodiment" or "in an embodiment" appearing throughout the specification does not refer to a same embodiment. In addition, these particular features, structures, or characteristics may be combined in one or more embodiments in any appropriate manner.

It should be understood that sequence numbers of the foregoing processes do not mean execution sequences in various embodiments of the present invention. The execution sequences of the processes should be determined based on functions and internal logic of the processes, and should not be construed as any limitation on the implementation processes of the embodiments of the present invention.

It should be understood that in the embodiments of this application, "B corresponding to A" indicates that B is associated with A, and B may be determined based on A. However, it should further be understood that determining A based on B does not mean that B is determined based on A only; that is, B may also be determined based on A and/or other information.

A person of ordinary skill in the art may be aware that units and algorithm steps of the examples described in combination with the embodiments disclosed in this specification may be implemented by electronic hardware, computer software, or a combination thereof. To clearly describe the interchangeability between the hardware and the software, the foregoing has generally described compositions and steps of each example based on functions. Whether the functions are performed by hardware or software depends on particular applications and design constraints of the technical solutions. A person skilled in the art may use different methods to implement the described functions for each particular application, but it should not be considered that such an implementation goes beyond the scope of the present invention.

A person skilled in the art may clearly understand that for ease of brief description, for detailed working processes of the foregoing system, apparatus, and unit, refer to corresponding processes in the method embodiments, and details are not described herein again.

In the several embodiments provided in this application, it should be understood that the disclosed system, apparatus, and method may be implemented in other manners. For example, the described apparatus embodiments are merely examples. For example, the unit division is merely logical function division and may be other division during actual implementation. For example, a plurality of units or components may be combined or integrated into another system, or some features may be ignored or not performed.

In addition, functional units in the embodiments of the present invention may be integrated into one processing unit, or each of the units may exist alone physically, or two or more units are integrated into one unit.

The foregoing descriptions are merely specific implementations of the present invention, but are not intended to limit the protection scope of the present invention. Any variation or replacement readily figured out by a person skilled in the art within the technical scope disclosed in the present invention shall fall within the protection scope of the present invention. Therefore, the protection scope of the present invention shall be subject to the protection scope of the claims.

What is claimed is:

1. A method for adjusting screen brightness, comprising:

obtaining image information of an image and information about an environment under which the image is displayed, and determining human eye characteristic information based on the information about the environment and the image information, wherein the human eye characteristic information is related to a minimum magnitude of a brightness change perceptible to human eyes;

obtaining information about a display screen for displaying the image, and calculating a screen backlight decreasable ratio based on the information about the display screen, the image information, and the human eye characteristic information;

determining a screen pixel brightness compensation ratio based on the screen backlight decreasable ratio, and determining an image optical compensation value based on the pixel brightness compensation ratio;

decreasing, based on the screen backlight decreasable ratio, screen backlight brightness when the display screen displays the image; and adjusting a pixel brightness value for the image based on the image optical compensation value.

2. The method for adjusting screen brightness according to claim 1, wherein the determining human eye characteristic information based on the information about the environment and the image information comprises:

invoking a human eye characteristic information table, wherein the table comprises a correspondence between the information about the environment, the image information, and the human eye characteristic information; and searching, based on the information about the environment, the image information, and the correspondence, for the human eye characteristic information corresponding to the information about the environment and the image information.

3. The method for adjusting screen brightness according to claim 1, wherein:

the image information comprises current backlight brightness and histogram information of the image;

the determining human eye characteristic information based on the information about the environment and the image information comprises:

determining the human eye characteristic information based on the information about the environment and the current backlight brightness; and the calculating the screen backlight decreasable ratio based on the information about the display screen, the image information, and the human eye characteristic information comprises:

calculating the screen backlight decreasable ratio based on the information about the display screen, the current backlight brightness, and the histogram information.

4. The method for adjusting screen brightness according to claim 1, wherein:

the determining a screen pixel brightness compensation ratio based on the screen backlight decreasable ratio comprises:

obtaining the pixel brightness compensation ratio based on the following formula, wherein tempGain is the pixel brightness compensation ratio, and BL ratio is the screen backlight decreasable ratio:

$$tempGain = \frac{255}{BL\ \text{ratio}}^{\frac{1}{2.2}};$$

and the determining the image optical compensation value based on the pixel brightness compensation ratio comprises:

calculating the image optical compensation value by using the following formula, wherein the image optical compensation value is $$\begin{bmatrix} R_{out} \\ G_{out} \\ B_{out} \end{bmatrix},$$

and an initial screen pixel brightness value is $$\begin{bmatrix} R_{in} \\ G_{in} \\ B_{in} \end{bmatrix} : \begin{bmatrix} R_{out} \\ G_{out} \\ B_{out} \end{bmatrix} = \begin{bmatrix} R_{in} \\ G_{in} \\ B_{in} \end{bmatrix} * tempGain.$$

5. The method for adjusting screen brightness according to claim 1 wherein the human eye characteristic information is used to determine that an actual brightness change magnitude of the display screen is less than a minimum magnitude of a brightness decreasing change perceptible to human eyes, after brightness of the display screen is adjusted based on the backlight decreasable ratio and the image optical compensation value.

6. The method for adjusting screen brightness according to claim 1, wherein the decreasing screen backlight brightness when the display screen displays the image comprises:

further decreasing, based on the screen backlight decreasable ratio, backlight brightness adjusted by using a backlight automatic brightness adjustment technology for current ambient light.

7. The method for adjusting screen brightness according to claim 1, wherein the information about the environment is luminance of ambient light.

8. A device for adjusting screen brightness, comprising:

a processor comprising a main function module, wherein the main function module is configured to:

obtain image information of an image, obtain, by using a sensor, information about an environment under which the image is displayed, and determine human eye characteristic information based on the information about the environment and the image information, wherein the human eye characteristic information is related to a minimum magnitude of a brightness change perceptible to human eyes;

obtain information about a display screen for displaying the image;

calculate a screen backlight decreasable ratio based on the information about the display screen, the image information, and the human eye characteristic information; and determine a screen pixel brightness compensation ratio based on the screen backlight decreasable ratio, and determine an image optical compensation value based on the pixel brightness compensation ratio;

a display module, configured to display the image;

a backlight brightness control module, configured to adjust, based on the screen backlight decreasable ratio, backlight brightness for the display module to display the image; and a display drive circuit, configured to adjust a pixel brightness value for the image based on the image optical compensation value.

9. The device for adjusting screen brightness according to claim 8, wherein the main function module comprises:

an image feature extraction unit, configured to extract the image information of the image;

an environment information collection module, configured to collect, by using the sensor, the information about the environment under which the image is displayed;

a display screen information obtaining unit, configured to obtain the information about the display screen for displaying the image;

a human eye characteristic information obtaining unit, configured to determine the human eye characteristic information based on the information about the environment and the image information, wherein the human eye characteristic information is related to the minimum magnitude of the brightness change perceptible to human eyes; and a backlight brightness and optical compensation calculation module, configured to calculate the screen backlight decreasable ratio based on the information about the display screen, the image information, and the human eye characteristic information, obtain the screen pixel brightness compensation ratio based on the screen backlight decreasable ratio, and determine the image optical compensation value based on the pixel brightness compensation ratio.

10. The device for adjusting screen brightness according to claim 9, wherein the human eye characteristic information obtaining unit is configured to:

invoke a human eye characteristic information table, wherein the table comprises a correspondence between the information about the environment, the image information, and the human eye characteristic information; and search, based on the information about the environment, the image information, and the correspondence, for the human eye characteristic information corresponding to the information about the environment and the image information.

11. The device for adjusting screen brightness according to claim 9, wherein:

the human eye characteristic information obtaining unit is configured to determine the human eye characteristic information based on the information about the environment and the current backlight brightness; and the backlight brightness and optical compensation calculation module is configured to calculate the screen backlight decreasable ratio based on the information about the display screen, the current backlight brightness, and the histogram information, and calculate the image optical compensation value based on the screen backlight decreasable ratio.

12. The device for adjusting screen brightness according to claim 9, wherein the backlight brightness and optical compensation calculation module:

obtains the pixel brightness compensation ratio based on the following formula, wherein tempGain is the pixel brightness compensation ratio, and BL ratio is the screen backlight decreasable ratio:

$$tempGain = \frac{255}{BL\ \text{ratio}}^{\frac{1}{2.2}};$$

and determines an optical compensation value based on the following formula, wherein the optical compensation value is $$\begin{bmatrix} R_{out} \\ G_{out} \\ B_{out} \end{bmatrix},$$

and an initial screen pixel brightness value is $$\begin{bmatrix} R_{in} \\ G_{in} \\ B_{in} \end{bmatrix} : \begin{bmatrix} R_{out} \\ G_{out} \\ B_{out} \end{bmatrix} = \begin{bmatrix} R_{in} \\ G_{in} \\ B_{in} \end{bmatrix} * tempGain.$$

13. The device for adjusting screen brightness according to claim 9, wherein the information about the environment collected by the information about the environment information collection module is luminance of ambient light when the image is displayed.

14. An apparatus for adjusting screen brightness, comprising:

one or more ports, configured to transmit information;

a processor, configured to:

obtain, by using one or more of the ports, image information of an image that is currently displayed, information about an environment under which the image is displayed, and information about a display screen for displaying the image, and determine human eye characteristic information based on the information about the environment and the image information, wherein the human eye characteristic information is related to a minimum magnitude of a brightness change perceptible to human eyes;

calculate a screen backlight decreasable ratio based on the information about the display screen, the image information, and the human eye characteristic information;

determine a screen pixel brightness compensation ratio based on the screen backlight decreasable ratio, and determine an image optical compensation value based on the pixel brightness compensation ratio; and apply the screen backlight decreasable ratio and the image optical compensation value to image display control.

15. The apparatus for adjusting screen brightness according to claim 14, further comprising:

a sensor, configured to collect the information about the environment;

a power management circuit, configured to control backlight brightness of the display screen based on the backlight decreasable ratio;

a display drive circuit, configured to adjust, based on the image optical compensation value, a pixel brightness value for the display screen to display the image; and the display screen, configured to display the image.

16. The apparatus for adjusting screen brightness according to claim 14, wherein the processor determines human eye characteristic information by:

invoking a human eye characteristic information table, wherein the table comprises a correspondence between the information about the environment, the image information, and the human eye characteristic information; and searching, based on the information about the environment, the image information, and the correspondence, for the human eye characteristic information corresponding to the information about the environment and the image information.

17. The apparatus for adjusting screen brightness according to claim 14, wherein the processor:

obtains the pixel brightness compensation ratio based on the following formula, wherein tempGain is the pixel brightness compensation ratio, and BL ratio is the screen backlight decreasable ratio:

$$tempGain = \frac{255}{BL\ \text{ratio}}^{\frac{1}{2.2}};$$

and determines an optical compensation value based on the following formula, wherein the optical compensation value is $$\begin{bmatrix} R_{out} \\ G_{out} \\ B_{out} \end{bmatrix},$$

and an initial screen pixel brightness value is $$\begin{bmatrix} R_{in} \\ G_{in} \\ B_{in} \end{bmatrix} : \begin{bmatrix} R_{out} \\ G_{out} \\ B_{out} \end{bmatrix} = \begin{bmatrix} R_{in} \\ G_{in} \\ B_{in} \end{bmatrix} * tempGain.$$

18. The apparatus for adjusting screen brightness according to claim 14, wherein the information about the environment collected by the sensor is luminance of ambient light.

19. The apparatus for adjusting screen brightness according to claim 14, wherein:

the image information comprises current backlight brightness and histogram information of the image;

the processor is configured to:

determine the human eye characteristic information based on the information about the environment and the image information by:

determining the human eye characteristic information based on the information about the environment and the current backlight brightness; and calculate the screen backlight decreasable ratio based on the information about the display screen, the image information, and the human eye characteristic information by:

calculating the screen backlight decreasable ratio based on the information about the display screen, the current backlight brightness, and the histogram information.

* * * * *